United States Patent [19]

Kengle et al.

[11] 4,303,194

[45] Dec. 1, 1981

[54] SMOKE PREVENTION APPARATUS

[75] Inventors: Fritz Kengle, N. Huntingdon; James E. Young, Pittsburgh, both of Pa.

[73] Assignees: U.S. Steel Corporation; Customized Controls, Inc., both of Pittsburgh, Pa.

[21] Appl. No.: 125,725

[22] Filed: Feb. 28, 1980

[51] Int. Cl.[3] ..... F23N 1/00

[52] U.S. Cl. ..... 236/15 E; 431/12

[58] Field of Search ..... 236/14, 15 E, 15 BD; 431/12, 76; 364/109

[56] References Cited

U.S. PATENT DOCUMENTS

| | | | |
|---|---|---|---|
| 2,562,507 | 7/1951 | Pierce | 236/15 E |
| 2,980,334 | 4/1961 | Giniesse | 236/14 |
| 3,216,661 | 11/1965 | Sawyer | 236/15 |
| 3,503,553 | 3/1970 | Schomaker | 236/14 |

*Primary Examiner*—William E. Wayner

*Attorney, Agent, or Firm*—William F. Riesmeyer, III

[57] ABSTRACT

This invention relates to an improvement in control apparatus which prevents formation of smoke in a combustion process. The conventional control includes apparatus for first providing the proper flow of either air or fuel to the process to satisfy the required demand for heat. A ratio device is then used to determine the flow of the remaining component necessary for obtaining proper combustion conditions. Where the BTU content of the fuel is likely to vary, a device for analyzing stack gases, typically an oxygen probe is then used to provide a signal to adjust the ratio device based on conditions indicated by the stack gases. The improvement of this invention includes a device for determining when the proportion of the exhaust gas component is outside limitations indicating smoking may occur and an emergency control device actuated when such conditions exist for rapidly adjusting the proportions of fuel and air supplied to the process in order to prevent smoking.

4 Claims, 2 Drawing Figures

SMOKE PREVENTION APPARATUS

BACKGROUND OF THE INVENTION

This invention relates to an improvement in combustion control apparatus, and particularly to apparatus for preventing smoke due to malfunction of an exhaust gas analysis device or slow response of the normal control apparatus to unfavorable combustion conditions indicated by the device.

In combustion processes in which the BTU content of the fuel supplied is likely to vary, it is known to adjust the ratio of fuel and air based on a measure of the combustion conditions from analysis of the oxygen content of the stack gas. This is particularly necessary where a boiler may be fed with oil or natural gas or blast furnace gas or combinations of them which can vary greatly in relative proportions. Even with such controls smoking often occurs.

U.S. Pat. No. 3,503,553 Schomaker shows apparatus for providing a minimum supply of air to the process and metering of the remaining air supply based on an oxygen controller in order to prevent dangerous conditions such as an excessive amount of fuel available upon startup of a boiler which can be dangerous. U.S. Pat. No. 2,562,507 shows apparatus for increasing the supply of air for combustion in response to an optical device which indicates smoke has formed in the stack. Neither reference is effective for preventing formation of smoke.

It is therefore a primary object of this invention to prevent formation of smoke in combustion processes utilizing stack gas analyses for metering control.

SUMMARY OF THE INVENTION

Figure 1:
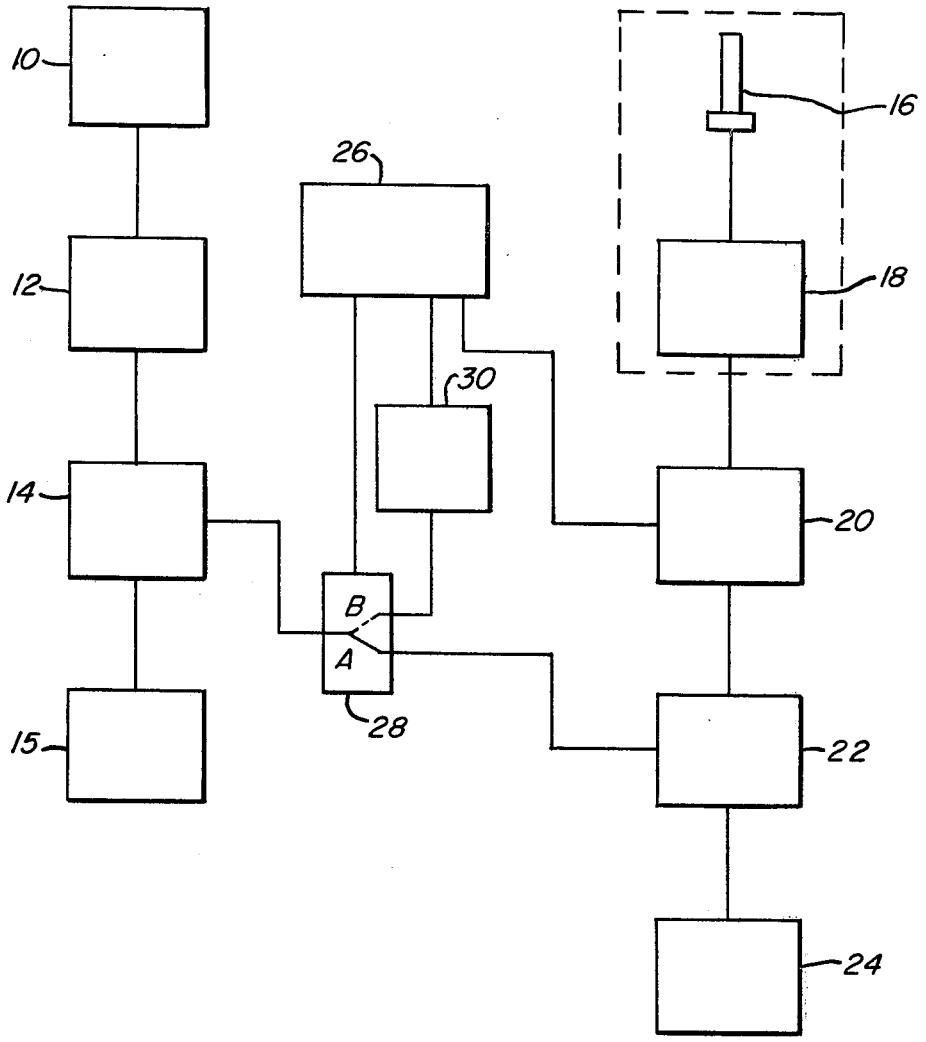
FIG. 1 is a schematic illustration of a conventional pneumatic system including the improvement of this invention.

Conventional combustion control apparatus includes demand signalling means for indicating the amount of heat required. To respond to the demand signal, means is provided for controlling the flow first of either fuel or air based on the demand. A ratio determining means then sets the flow of the other component i.e. air or fuel to provide good combustion conditions. An analysis means is provided for determining the proportion of at least one of the components in the stack gases so as to indicate the actual combustion conditions. This proportion is then entered into the ratio means and the ratio is adjusted at least in part based on this reading. Such controls are often used where various fuels are used either successively or in various combinations and the BTU or heat content may vary considerably. We have found that even with such controls smoking often occurs. This may be due on the one hand to malfunction of the analysis device which gives a false reading, or to rapid, excessive variation in the heat content of the incoming fuel. To correct this we have found that limits can be set on the readings of the analysis device which indicate either a malfunction, or a rapid change in the fuel, but in any case which require immediate adjustment of the fuel-air ratio beyond that provided by the normal ratio device.

Therefore, according to his invention we provide in combination with this normal control apparatus, means for determining when the proportion of the measured exhaust gas component is outside one or more predetermined limitations, and emergency control means actuated by the limit setting means for adjusting the fuel and air supplied to the process to provide more favorable combustion conditions. When the analysis device again indicates combustion conditions are proper, the emergency control means is deactuated.

Preferably, the analysis means measures oxygen content of the stack gases. When the device fails, it may give a full scale reading i.e. the highest oxygen on the scale. Therefore an upper limit may be set for oxygen content in order to indicate malfunction of the device. Similarly, too low of an oxygen reading indicates combustion conditions which will cause smoke to form. This often occurs when the heat content of the fuel varies rapidly and the ratio device cannot compensate quickly enough. Pneumatic control devices for example are slow in responding and cause this problem. Therefore, a lower limit can be set on oxygen content where the emergency control should take over. This lower limit may be different for various fuels, for example about 1% for natural gas or 3.5% for oil. Where combinations of fuel are used the lower limit should be set conservatively to prevent smoking regardless of the fuel composition during an instantaneous time period. It is also within the scope of the invention however, to provide an automatic adjustment of the limits based on the fuel components at any particular time.

The emergency control may provide adjustment directly to the ratio means in order to override the normal signal from the analyzing means, or directly control fuel or air flow i.e. to decrease fuel or increase air sufficiently to adjust the ratio to provide more favorable combustion conditions.

DESCRIPTION OF THE PREFERRED EMBODIMENT

Referring to FIG. 1, a pneumatic control system is shown for a boiler fired primarily by blast furnace gas supplemented with oil or natural gas as necessary to satisfy demand for steam. Demand signalling device 10 responds to an indication of steam pressure from the boiler and calls for heat when the pressure falls below a certain set-point. A demand signal is then sent from device 10 to an air flow transmitter 12 which sets the rate of flow of air in order to obtain the amount of combustion necessary to satisfy the demand. Although the system illustrated is an air-lead type it will be apparent to those skilled in the art that the invention is equally applicable to a fuel-lead system. A pneumatic signal from transmitter 12 is sent to fuel-air ratio multiplier 14 which then calls for a certain flow rate of fuel 15 based on the air flow. The ratio of multiplier 14 is adjusted in known fashion according to actual combustion conditions as indicated by continuous stack gas analysis. To do this, probe 16 measures the oxygen content of the stack gas and provides a voltage output inversely proportional to the oxygen content. Linearizer 18 inverts the voltage output from the probe and linearizes the signal to provide a milliamperage directly proportional to oxygen content. Converter 20 then changes the current to a pneumatic pressure signal proportional to the oxygen content of the stack gas. The pressure signal from converter 20 is fed to totalizer 22 which sends a pneumatic output signal to multiplier 14 relative to a pneumatic signal from setpoint 24 which is manually set for the desired oxygen content in the stack gas to provide good combustion conditions.

The improvement of this invention includes, means for detecting when the oxygen content in the stack gases is outside certain pre-determined minimum and maximum limits. We use a pressure switch 26 part number J-300 made by United Electric Company. We enter a minimum value of pressure for example, 3 lbs. which corresponds to 1% oxygen in the stack gas, and a maximum pressure of 27 lbs. which corresponds to 9% oxygen, as limits in the switch. When the pressure is within these limits the switch remains energized.

The inventive apparatus also includes a three-way solenoid valve 28 such as that made by ASCO part number 8320B174. The valve is connected electrically to switch 26 so that when switch 26 is energized the valve is in position A and transmits the pneumatic signal from totalizer 22 to multiplier 14. When switch 26 is de-energized, i.e. the pressure and oxygen content are outside limits valve 28 is in position B so as to transmit a preset pneumatic signal from set-point 30 to multiplier 14. The preset signal from set-point 30 is adjusted initially to a pre-determined value which sets the ratio of multiplier 14 to a value which will conservatively provide good combustion conditions for the type of fuels being burned. It will be apparent that when the oxygen content in the stack gases again is with in limits switch 26 will become energized and move solenoid 28 to position A for normal control.

The operation of the device may be indicated by consideration of the following table.

TABLE I

| | PRESSURE SIGNAL FROM $O_2$ PROBE | $O_2$ SET-POINT TO TOTALIZER | OUTPUT OF TOTALIZER TO RATIO MULTIPLIER | 3 lbs. min. 27 lbs. max. PRES. SWITCH LIMITS | EMERGENCY CONTROL SET-PT. | FUEL FLOW |
|---|---|---|---|---|---|---|
| A | 6 lbs(2% $O_2$) | 9 lbs(3% $O_2$) | Decrease F/A Ratio | within | Not Applic. | Decrease |
| B | 12 lbs(4% $O_2$) | 9 lbs(3% $O_2$) | Increase F/A Ratio | within | Not Applic. | Increase |
| C | 30 lbs(10% $O_2$) indicates probe mal-function | 9 lbs(3% $O_2$) | Not Applicable (Wants large increase F/A Ratio) | outside | Preset F/A Ratio (3% $O_2$) | Prevents Excessive Increase |
| D | 0 lbs(0% $O_2$) due to rapid change in BTU content of fuel | 9 lbs(3% $O_2$) | Not Applicable Lags- Does. not call for Decreased F/A Ratio Immediately | Outside | Preset F/A Ratio (3% $O_2$) | Decreases Fuel Rapidly Until Totalizer Lag is Corrected |

In condition A, the probe indicates 2% oxygen in the stack gas which is below the value of 3% called for by the set-point. Therefore the totalizer sends out a signal to decrease the fuel-air ratio which in the system illustrated decreases the flow of fuel since air is independently set by the demand for heat. Condition B is the opposite of A in that the probe indicates 4% oxygen which is greater than the 3% set-point value. The totalizer then sends a signal to increase the ratio which again in this system increases fuel flow. The emergency control remains inactive in both conditions A and B. However, in condition C the probe malfunctions and indicates full scale or 10% oxygen. The emergency control takes over and provides a signal to the ratio multiplier which will provide a known good combustion condition i.e. a desirable fuel-air ratio. Where fuels of various BTU contents are burned, the ratio is set conservatively to provide good conditions for any of the fuels being used. This prevents the totalizer from increasing the fuel-air ratio as it would tend to do based on the 10% oxygen reading. Similarly, in condition D, the probe reads 0% oxygen. This may be caused by very rapid swings in the BTU content of the fuel. The totalizer is not able to immediately adjust to this condition. It therefore is still tending to call for a fuel-air ratio based on a low-BTU content fuel mix. This would result in excessive amount of fuel available for combustion and cause a smoking condition. The emergency control however, takes over because the oxygen is outside limits. Therefore, a known fuel-air ratio for good combustion conditions is applied to prevent smoking until the probe again indicates oxygen within limits.

Figure 2:
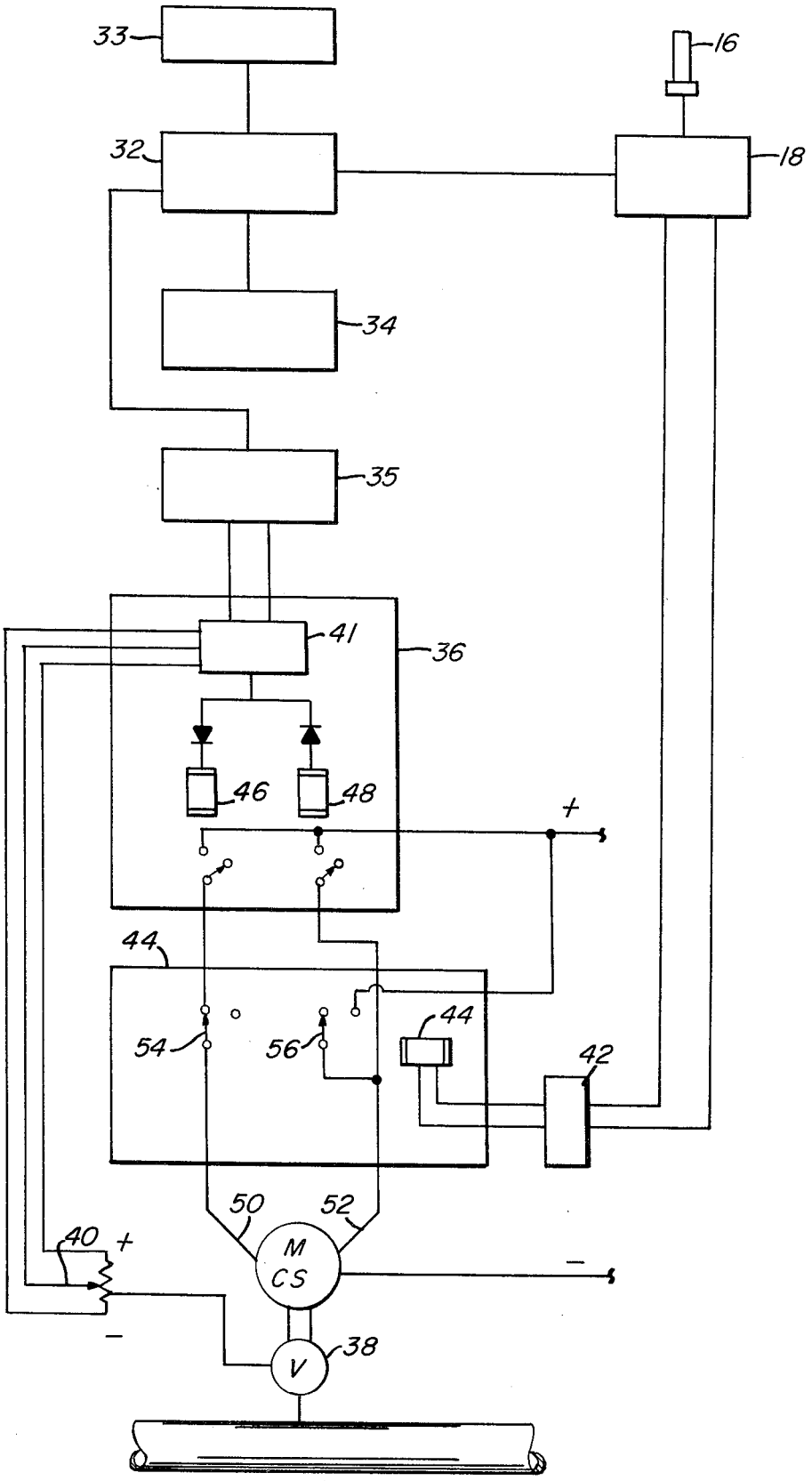
FIG. 2 is a schematic illustration of a conventional electrical control system including an alternative embodiment of this invention.

An alternative embodiment is shown in FIG. 2. A programmable controller 32 receives a demand signal 33, sets an air flow 34, and determines a desired fuel-air ratio based on an electrical signal from oxygen probe 16 and linearizer 18 as previously described. A fuel flow input from controller 32 based on the ratio is provided to manual automatic station 35. We use a Sigma Lumigraph W55CC manual-automatic station which sets a current value corresponding to the desired fuel flow in converter 36 which controls the operation of electric gas valve drive unit 38. Valve drive unit 38 contains a potentiometer 40 connected to comparator 41 to control position of the valve compared to desired flow based on the demand signal from manual-automatic station 34.

The inventive apparatus in this embodiment includes alarm module 42 in which upper and lower limits of current (corresponding to oxygen content) from probe 16 and linearizer 18 are set. Relay 44 connected to module 42 provides emergency control of the gas valve when the oxygen is outside limits set in the alarm module. Under normal circumstances when oxygen is within limits converter 36 controls valve 38 through alternate open and closed contacts 46, 48 which respectively energize either open or close loops 50, 52 of the drive motor for opening or closing the valve until the comparator indicates the valve position corresponds to that called for by the signal from manual-automatic station 35. However, when the oxygen is outside limits, alarm module 42 opens contact 54 of relay 44 and closes contact 56. This energizes the valve drive unit through close loop 52 to close the valve. It should be noted that in this embodiment no control is necessary to preset a fuel rate corresponding to a known good combustion condition. Closing the valve typically takes 30–45 seconds and during this time period the change in combustion conditions will be indicated by the probe reading. When the probe again provides a reading within limits the relay switches so as to open contact 56 and close contact 54 and go back to normal ratio control. It should also be noted that if the oxygen is outside limits due to malfunction of the probe, the probe will normally respond to a change in oxygen content and start functioning normally again so that the valve will not completely close.

We use a Honeywell Model R7165A-1102 converter (or valve positioner) 36 in FIG. 2 and a Moore DCA (4–20 Millilamp) D×1×3 for alarm module 42. We also use a Potter Brumfield KRP/4AG for relay 44. It will be apparent that other electric apparatus for performing the same functions is available as well as those listed above. Referring again to FIG. 1, we use standard equipment for the conventional part of the control apparatus. For example, for air flow transmitter 12 we use a Type "D" sending head made by Hagan Company, a division of Westinghouse Electric. For probe 16, we use a Model 218 Part No. 6630D14G22 oxygen probe made by Westinghouse. The probe includes a temperature controller 6630D20 which maintains a gas sample temperature of about 1500° F. to provide uniformly accurate readings. We also use a 55CM03 linearizer supplied by Westinghouse and an ITT Model T-25 current to pressure converter 20.

We claim:

1. In an apparatus for controlling a combustion process, said apparatus including demand signalling means for indicating the amount of heat required in said process, means responsive to said demand signalling means for controlling the flow of one of the components for combustion selected from the group consisting of fuel and air based on said demand, analysis means for determining the proportion of at least one of the components of exhaust gases emitted from said process so as to indicate the conditions of combustion therein, means for determining the ratio of fuel and air to be supplied to said process based at least in part on the proportion of said measured exhaust gas component, and means for controlling the flow of the other of said components for combustion in accordance with the ratio determined by said ratio means, the improvement in which said apparatus further comprises:

means for determining when the proportion of said exhaust gas component is outside a pre-determined limitation indicating a smoking condition is about to occur in said process, and emergency control means actuated when the proportion of said exhaust gas component is outside said limitation and deactuated when said component is within said limitation, said control means adjusting the proportion of fuel and air supplied to said process when so actuated so at to prevent smoking.

2. The apparatus of claim 1 wherein said analysis means comprises means for measuring the oxygen content of said exhaust gases.

3. The apparatus of claim 1 wherein said control means, when actuated, adjusts said ratio means to a fuel and air ratio known to provide a good combustion conditions for the type of fuel being burned.

4. The apparatus of claim 1 wherein said control means, when actuated, directly adjusts the flow of the other of said components for combustion in a direction to provide good combustion conditions and prevent smoking.

* * * * *

UNITED STATES PATENT AND TRADEMARK OFFICE

CERTIFICATE OF CORRECTION

PATENT NO. : 4,303,194

DATED : December 1, 1981

INVENTOR(S) : Kengle et al

It is certified that error appears in the above-identified patent and that said Letters Patent are hereby corrected as shown below:

Column 1, line 38, after "pneumatic" insert -- control --

Column 2, line 30, "an" should be -- any --

Column 5, line 13, "Millilamp" should be -- Milliamp --

Column 6, line 22, "at" should be -- as --

Column 6, line 28, after "provide" delete "a"

Signed and Sealed this

*Eighteenth* Day of *May 1982*

[SEAL]

*Attest:*

GERALD J. MOSSINGHOFF

*Attesting Officer*

*Commissioner of Patents and Trademarks*